US007814734B2

(12) United States Patent
Bilkie, Jr.

(10) Patent No.: US 7,814,734 B2
(45) **Date of Patent: *Oct. 19, 2010**

(54) PACKAGING SYSTEM AND METHOD FOR CLOSED CONTAINER DETECTION

(75) Inventor: Thomas A. Bilkie, Jr., Medina, OH (US)

(73) Assignee: Ranpak Corp., Concord Township, OH (US)

( * ) Notice: Subject to any disclaimer, the term of this patent is extended or adjusted under 35 U.S.C. 154(b) by 71 days.

This patent is subject to a terminal disclaimer.

(21) Appl. No.: 12/063,709

(22) PCT Filed: Aug. 21, 2006

(86) PCT No.: PCT/US2006/032521

§ 371 (c)(1),
(2), (4) Date: Feb. 13, 2008

(87) PCT Pub. No.: WO2007/022480

PCT Pub. Date: Feb. 22, 2007

(65) Prior Publication Data

US 2008/0141625 A1 Jun. 19, 2008

Related U.S. Application Data

(60) Provisional application No. 60/709,976, filed on Aug. 19, 2005.

(51) Int. Cl.
*B65B 1/04* (2006.01)

(52) U.S. Cl. ..... 53/473; 53/52; 53/503; 53/504; 493/464; 493/967

(58) Field of Classification Search ..... 53/52, 53/115, 428, 472, 473, 503, 504; 493/464, 493/967

See application file for complete search history.

(56) References Cited

U.S. PATENT DOCUMENTS 3,819,918 A * 6/1974 Hale ..... 702/156

(Continued)

FOREIGN PATENT DOCUMENTS

WO 01/94107 12/2001
WO 2006/017602 2/2006

OTHER PUBLICATIONS

International Search Report of International Application No. PCT/US2006/032521, published as International Publication No. WO/2007/022480.

*Primary Examiner*—Thanh K Truong
(74) *Attorney, Agent, or Firm*—Renner, Otto, Boisselle & Sklar, LLP

(57) ABSTRACT

A packaging system (10), and associated components and methodology, that provides for automatic detection of a full, overfull, closed or partially closed container, even when mixed with other containers. An exemplary packaging method includes the following steps: (a.) determining the dimensions of a container; (b.) detecting a height of the container and its contents in one or more locations within a scan area of an open side of the container; (c.) comparing the detected height of the container and/or its contents to pre-specified criteria; and (d.) when the detected height exceeds the pre-specified criteria, generating a signal that indicates that the scan area includes a height that exceeds the pre-specified criteria.

17 Claims, 6 Drawing Sheets

U.S. PATENT DOCUMENTS

| | | | | |
|---|---|---|---|---|
| 4,924,506 | A * | 5/1990 | Crossley et al. | 382/286 |
| 5,123,889 | A | 6/1992 | Armington et al. | |
| 5,142,160 | A * | 8/1992 | Storbeck | 250/559.08 |
| 5,719,678 | A * | 2/1998 | Reynolds et al. | 356/627 |
| 5,871,429 | A | 2/1999 | Harding et al. | |
| 7,161,688 | B1 * | 1/2007 | Bonner et al. | 356/627 |
| 7,337,595 | B2 * | 3/2008 | Harding | 53/504 |
| 2005/0050848 | A1 | 3/2005 | Harding | |

* cited by examiner

PACKAGING SYSTEM AND METHOD FOR CLOSED CONTAINER DETECTION

This invention claims the benefit of International Application No. PCT/US2006/032521, filed 21 Aug. 2006, published in English as WO 2007/022480, which claims the benefit of U.S. Provisional Patent Application No. 60/709,976, filed 19 Aug. 2005, both of which are hereby incorporated herein in their entirety.

FIELD OF THE INVENTION

The invention described in the following paragraphs relates generally to a packaging system and method for providing a controlled quantity of dunnage material to top-fill a container in which one or more articles are packed for shipping. In particular, the invention relates to a system and method for automatically scanning a container to determine dunnage requirements.

BACKGROUND

In the process of shipping one or more articles in a container from one location to another, a dunnage material typically is placed in the container to fill any voids around the articles and thus prevent or minimize any shifting movement of the articles within the container during shipment. Some commonly used dunnage materials are plastic foam peanuts, plastic bubble pack, air bags, and converted paper dunnage material.

One way to determine how much dunnage is needed in a container is disclosed in U.S. Pat. No. 5,871,429. The '429 patent discloses a packaging system comprising (i) a probe for sensing the void in a container, (ii) a dunnage converter, and (iii) a controller for controlling the converter's feeding and cutting of a strip of dunnage material to produce a sufficient quantity of dunnage to fill the void in the container based on the information provided by the probe. The probe can be a mechanical probe used to probe a container in one or more locations to determine the amount of dunnage material needed to fill the void. The probe can be used in conjunction with or supplanted by a bar code reader or other sensors, including optical and ultrasonic sensors, that sense the dimensions or degree of fill of the container.

Common types of containers include a shoebox-style container and a regular slotted container (RSC). A shoebox-style container has an opening on one side and a separate lid for closing the opening. An RSC has flaps extending from the sides of the container that can be folded down over the top and then secured in place. Typically articles are placed in an RSC container with the flaps in an upright configuration, and the flaps generally remain in that configuration until the container is ready to be closed for shipping.

SUMMARY

Although the flaps of an RSC typically remain upright to enable a probe or other sensor to access the void volume, sometimes one or more flaps are partially folded inward or completely closed, which can make it difficult or impossible for the probe to measure the void volume. The present invention provides a system, and associated components and methodology, that provides for automatic detection of a full, overfull, closed or partially closed container, even when mixed with other containers. In an exemplary system, a signal is generated to indicate a problem that an operator should investigate before dunnage is dispensed.

In a semi-automated dunnage dispensing system, an operator initiates dispensing the dunnage, but the amount of dunnage dispensed generally is predetermined based on the measured void volume. If the container is even partially closed, the system cannot accurately determine the amount of dunnage to be dispensed to that container and the operator is alerted. The operator can open the container, and either return the container to the packaging line upstream of the sensor, or manually place or dispense dunnage into the container to fill the void volume. In an automated system, which generally doesn't require any operator intervention, a closed container can be diverted or otherwise brought to an operator's attention for special handling.

In addition, a void volume cannot be calculated if the container is already full. This is another fault condition that requires an operator's attention.

Another fault condition that requires an operator's attention is when the contents of the container extend above the top of the container. If the contents are compressible, the flaps can be closed for shipment. If not, then one or more contents of the container must be removed or repositioned. Either fault condition can be referred to as an overfull container, and requires an operator's attention.

Alternatively, if one or more flaps are only partially closed, the system can estimate the void volume and dispense dunnage based on that estimate. This system reduces the number of containers that require operator intervention.

More particularly, exemplary systems and methods in accordance with the present invention are set forth in the claims, which are summarized in the following paragraphs.

An exemplary packaging method, for example, includes the following steps: (a.) determining the dimensions of a container; (b.) detecting a height of the container and its contents in one or more locations within a scan area of an open side of the container; (c.) comparing the detected height of the container and/or its contents to pre-specified criteria; and (d.) when the detected height exceeds the pre-specified criteria, generating a signal that indicates that the scan area includes a height that exceeds the pre-specified criteria.

The detecting step can include using a contour sensor to scan the scan area to determine a contour of the container and its interior space in the scan area.

The determining step can include using one or more sensors to detect at least one of a height characteristic, a width characteristic, a length characteristic and a contour characteristic of a container and its contents.

The method can include the step of determining the void volume in the container from the determined dimensions of the container and the detected height of the container and its contents in the scan area.

The method can include the step of determining a quantity of dunnage needed to fill the determined void volume, and the step of providing the determined quantity of dunnage. The providing step can include converting a sheet stock material into a dunnage product.

The method can include the step of setting the pre-specified criteria as a height at a predetermined number of locations that exceeds the determined height dimension of a container, or setting the pre-specified criteria as a height at a predetermined number of locations that exceeds a predetermined percentage of the determined height of the container.

The generating step can include generating an audible or visual signal, generating a signal to stop a conveyor transporting the container, and/or generating a signal to divert a container from a path to a dunnage dispenser.

The method can include the step of calculating a void volume inside the container from the determined dimensions of the container and the detected height of the container and its contents in the scan area when the detected height does not exceed the pre-specified criteria.

The method can include the step of determining a quantity of dunnage to dispense if the void volume is greater than a predetermined minimum void volume.

The detecting step can include detecting a height in a scan area that is less than a full cross-section of the container defined by the perimeter of the open side of the container at top edges of the side walls of the container.

The method can include the step of defining a perimeter of the container as an outside perimeter and defining an inside perimeter that is offset a predetermined distance inside the outside perimeter as the perimeter of the scan area.

An exemplary packaging system includes (a.) means for determining the dimensions of a container; (b.) means for detecting a height of the container and its contents in one or more locations within a scan area of an open side of the container; (c.) means for comparing the detected height of the container and/or its contents to pre-specified criteria; and (d.) means for generating a signal that indicates that the scan area includes a height that exceeds the pre-specified criteria when the detected height exceeds the pre-specified criteria.

Another exemplary packaging method includes the following steps: (a.) determining the volume of a container when the container is empty; (b.) determining a void volume inside the container; (c.) comparing the determined void volume to pre-specified criteria; and (d.) if the determined void volume exceeds the pre-specified criteria, generating a signal that indicates that the determined void volume exceeds the pre-specified criteria.

The method can include the step of setting a pre-specified criteria as a predetermined percentage of the volume of the container when empty or a predetermined volume.

Another exemplary packaging system includes: (a.) means for determining the volume of a container when the container is empty; (b.) means for determining a void volume inside the container; (c.) means for comparing the determined void volume to pre-specified criteria; and (d.) means for generating a signal that indicates that the determined void volume exceeds the pre-specified criteria if the determined void volume exceeds the pre-specified criteria.

The foregoing and other features of the invention are hereinafter fully described and particularly pointed out in the claims, the following description and the annexed drawings setting forth in detail one or more illustrative embodiments of the invention. These embodiments, however, are but a few of the various ways in which the principles of the invention can be employed. Other articles, advantages and features of the invention will become apparent from the following detailed description of the invention when considered in conjunction with the drawings.

DETAILED DESCRIPTION

Figure 1:
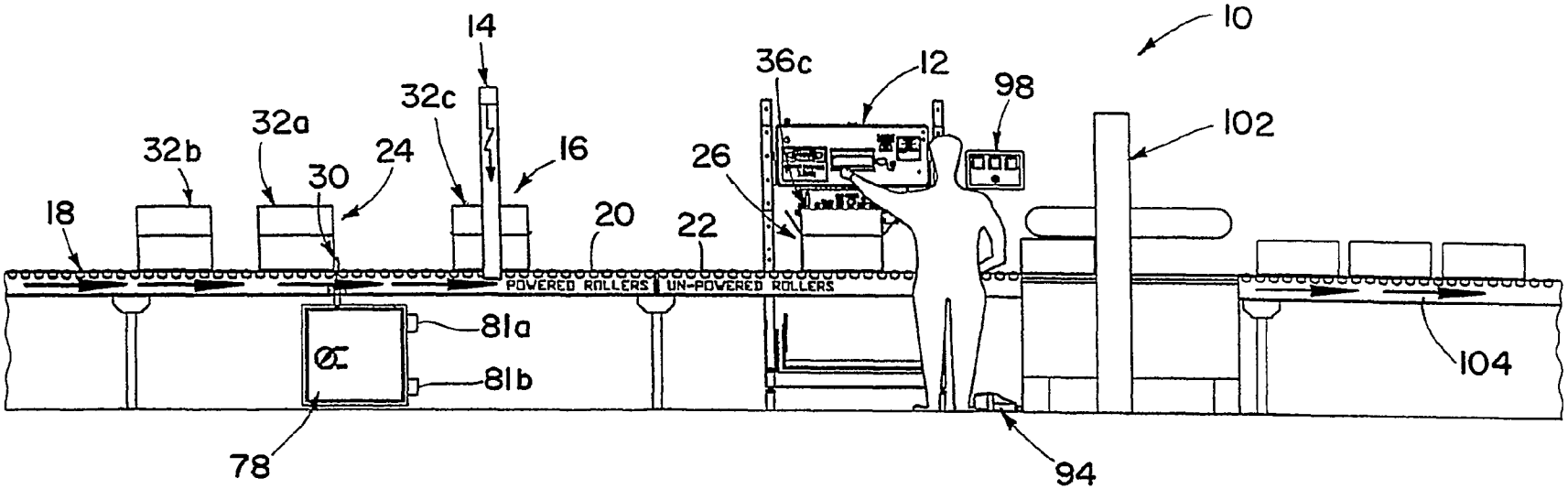
FIG. 1 is a schematic illustration of an exemplary void-fill measuring and dispensing system according to the invention.

Referring now in detail to the drawings and initially to FIG. 1, an exemplary void-fill measuring and dispensing system 10 is operative to automatically determine and supply an amount of dunnage material sufficient to fill the void volume in a container, and to divert or otherwise bring fault conditions to an operator's attention, including full, overfull, or partially or completely closed containers.

The system 10 generally comprises a dunnage dispenser 12 which is operable to dispense a controlled amount of a dunnage material, a container scanner 14 having a scan region 16, and a container conveyor 18 for conveying a container through the scan region 16. The container scanner 14 includes one or more sensors to detect dimensional characteristics of the container and its contents, and a logic device for determining or estimating a void volume, or identifying a fault condition, based on the detected dimensional characteristics.

Containers move through the illustrated system 10 via the container conveyor 18 (which can form at least part of a packing line conveyor). The illustrated conveyor has a powered section 20 and an un-powered section 22. In the illustrated embodiment, the powered section 20 extends at least through the scan region 16 and to the un-powered section 22. The un-powered section 22 extends from the powered section 20 through a dunnage fill area 26 proximate the dunnage dispenser 12.

The conveyor 18 includes a stop gate 30 of any suitable type for controllably permitting passage of containers out of a holding station 24 and into the scan region 16. In the illustrated preferred embodiment, the stop gate 30 is a retractable stop member that in an extended position will block passage of a container 32*a* and thereby hold the container 32*a* at the holding station 24. When the stop member 30 is retracted, the powered section 20 of the conveyor 18 moves the container 32*a* out of the holding station 24. Shortly after the container 32*a* is released, the stop member 30 is extended to capture and hold the next container 32*b* at the holding station 24, whereby containers are controllably fed into and through the scan region 16. In addition or as an alternative to using a stop gate, the conveyor can have two segments with a downstream segment moving faster than an upstream segment to create a gap between and separate the containers when they move through the scan region. This separation makes it easier to determine the void volume in each container.

Figure 3:
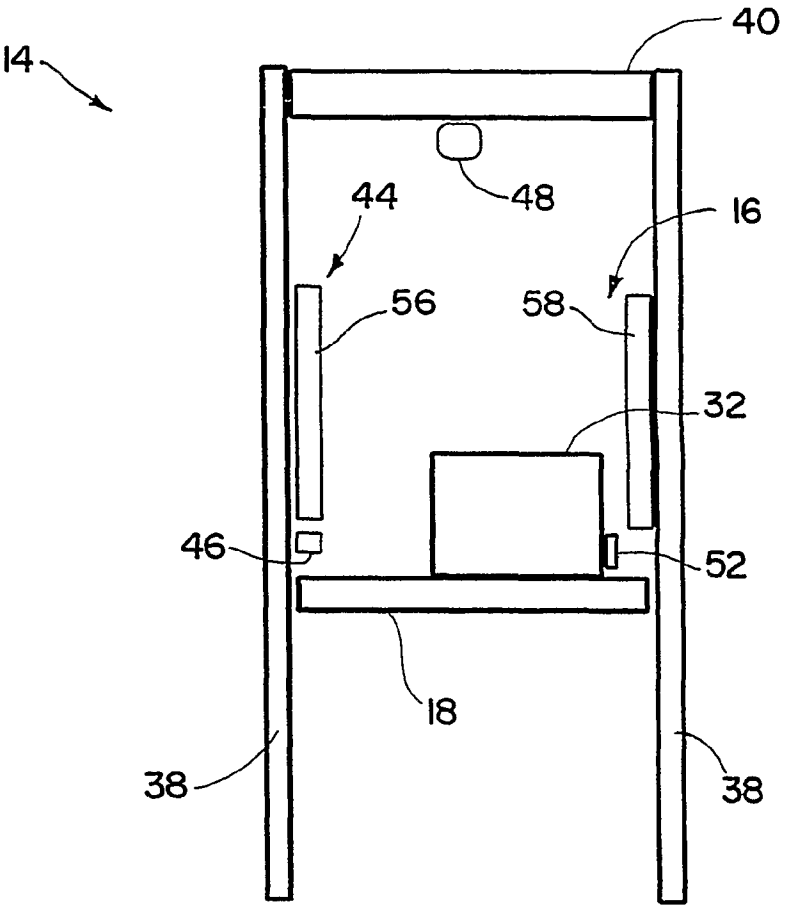
FIG. 3 is an end view of the container scanner of FIG. 2, looking from the line 3-3 of FIG. 2.
Figure 2:
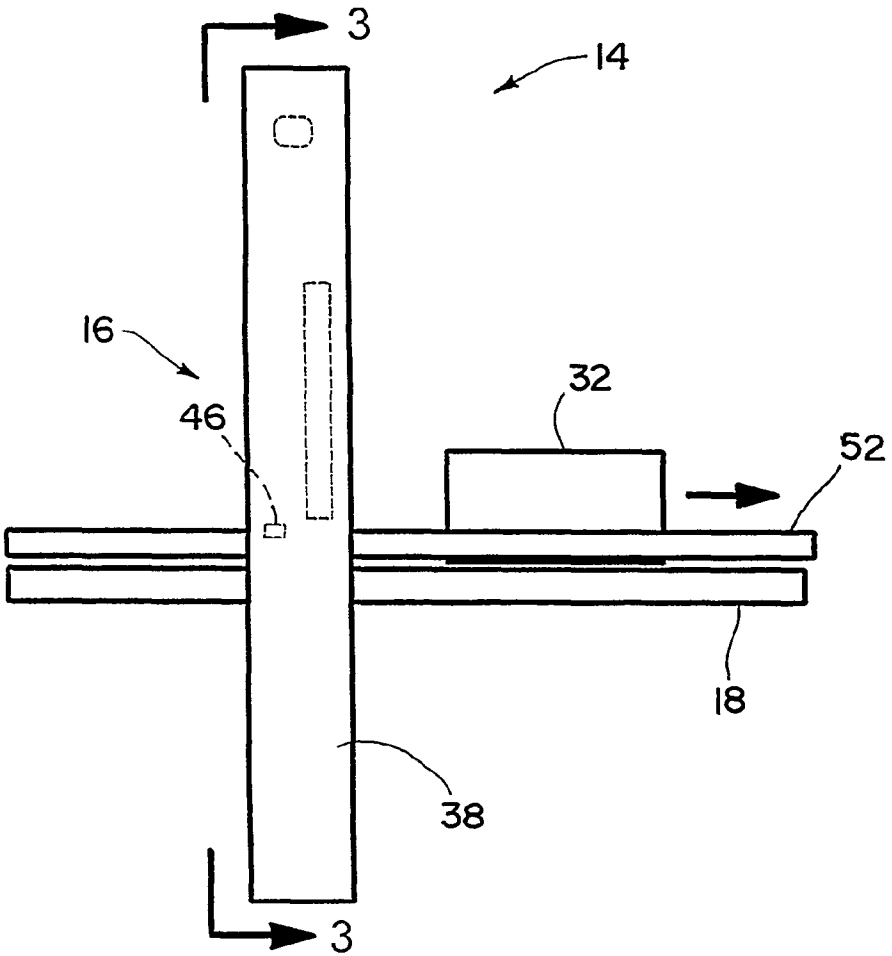
FIG. 2 is a schematic of the container scanner used in the system of FIG. 1.

The container scanner 14 includes one or more sensors for detecting the dimensional characteristics of the container and its contents, which can be used to determine the size of the container and the void volume. As shown in FIGS. 2 and 3, an exemplary container scanner 14 includes a frame 38 having a pair of uprights straddling the container conveyor 18 and a cross beam 40 supported atop the uprights at a fixed distanced from the conveyor surface. The uprights, for example, can be floor supported as shown in FIGS. 2 and 3, or can be mounted to the conveyor 18 as illustrated in FIG. 1.

The sensors of the container scanner 14 generally are mounted to the frame 38 and can include infrared, ultrasonic, laser, mechanical or other type of sensors. As will be appreciated, the dimensional characteristic data from each of the sensors can be supplied in real time via suitable communication means. In the illustrated exemplary embodiment, the sensors include a height sensor 44 for sensing a height characteristic of a container, a width sensor 46 for sensing a width characteristic of the container, and a contour sensor 48 for sensing a contour characteristic in a scan area in an open side of the container.

The width sensor 46 can be any suitable sensor for determining a width characteristic of the container passing through the scan region 16. In the illustrated embodiment, the width sensor 46 is an infrared distance sensor that can be used to measure the distance from the sensor to a side of the container or other reference point. In the illustrated embodiment, the width sensor is mounted to one of the uprights of the scanner frame 38 at a location just above the level of the conveyor. To obtain the width of the container, the location of the other side of the container can be registered at a known distance from the width sensor 46. To this end, the containers are registered against a guide rail 52 on the side of the conveyor 18 opposite the width sensor, which guide rail 52 is at a known distance from the width sensor and thus functions as a zero reference. Any suitable means can be employed to register the container against the guide rail 52. Accordingly, the width of the container will be the difference between the location of the guide rail 52 and the measured location of the side of the container nearest the width sensor 46.

The height sensor 44 can be any suitable sensor for determining a height characteristic of the container in the scan region 16. An exemplary sensor 44 includes an array 56 of emitters and an array 58 of receivers disposed on opposite transverse sides of the scan region. In the illustrated exemplary embodiment, the emitter and receiver arrays 56 and 58 are mounted respectively to the scanner frame uprights 38. Each array includes a row of emitters/receivers that is oriented perpendicular to the plane of the conveyor 18. Accordingly, the emitter array 56 produces a curtain of light that is sensed by the receiver array 58. As a container moves through the curtain, the container interrupts the curtain of light and provides a height characteristic from which the container height can be determined.

A sensor could be dedicated to measuring the length of the container, but in the illustrated embodiment the container length is determined indirectly by measuring the length of time the container takes to pass any one of the sensors, and by knowing the speed at which the conveyor 18 is moving the container past the sensor. The length of time multiplied by the speed of the conveyor yields the length of the container. If the speed of the conveyor is a known constant, then only the length of time needs to be sensed in order to obtain the length of the container. If the speed of the conveyor varies or for other reasons, a conveyor speed sensor 96 can be used to sense the conveyor speed and communicate the speed to the control unit 76 for processing. The speed sensor, for example, can be an encoder interfaced with the conveyor drive motor for providing a series of pulses, the rate of which is proportional to the speed of the motor and thus the conveyor. The control unit can be calibrated to convert the pulse rate to a container speed that can be multiplied with the container passage time measured by a sensor, such as the width sensor.

The contour sensor 48 can be any suitable sensor for detecting a contour characteristic of the container and/or its contents as the container passes through the scan region 16. In the illustrated embodiment, the contour sensor 48 is mounted to the cross beam 40 of the frame 38 above the scan region 16. The contour sensor 48 typically is of a type that continuously scans the top surface of the container and/or its contents at one or more locations in a scan area inside the open side of the container as the conveyor 18 moves the container through the scan region 16.

An exemplary contour sensor is a non-contact optic laser scanner that operates by measuring the time of flight of laser light pulses, such as the Sick Optic LMS 200-30106 laser scanner, available from SICK, Inc. of Minneapolis, Minn., U.S. The laser scanner emits a pulsed laser beam that is reflected if it meets an article and a receiver portion of the scanner registers the reflected laser beam. The time between transmission and reception of the reflected impulse is directly proportional to the distance between the laser scanner and the article. The pulsed laser beam can be deflected by an internal rotating mirror so that a fan-shaped scan is made of the surrounding area, whereupon the contour of the surface below the scanner (i.e., distance from a fixed reference point/plane) is determined from the sequence of impulses received. The fan beam is oriented perpendicular to the movement path of the container through the scan region 16. Moreover, the contour sensor 48 is arranged to detect the contour characteristic of the container and/or its contents, and thus detects the height at one or more locations within a scan area of an open side of the container as the container moves through the scan region 16.

As an alternative to this three-sensor arrangement, the container scanner can include just one sensor, namely the contour sensor 48. If the speed of the conveyor 18, and thus the container, through the scan region 16 is known, the contour characteristics detected by the contour sensor can be used to determine the height, width and length of the container.

The field of view of the container scanner 14 defines the scan region 16. The scan region 16 typically is about the width of the widest and height of the tallest anticipated container, and generally has a width that equals the width of the conveyor 18. Contour characteristic data represents the height of the container and/or its contents within a scan area of an open side of the container. The scan area generally is less than the scan region. The contour characteristic data is used to determine fault conditions, such as a height of container contents the height of the container, inwardly-folded flaps, etc. While the scan region generally is constant, the scan area can vary with the dimensional characteristics being detected and the size of the container. For example, the scan area can be defined by the logic device as the width of the container, and the logic device can ignore data collected outside the scan area, and thus outside the width of the container.

Figure 4:
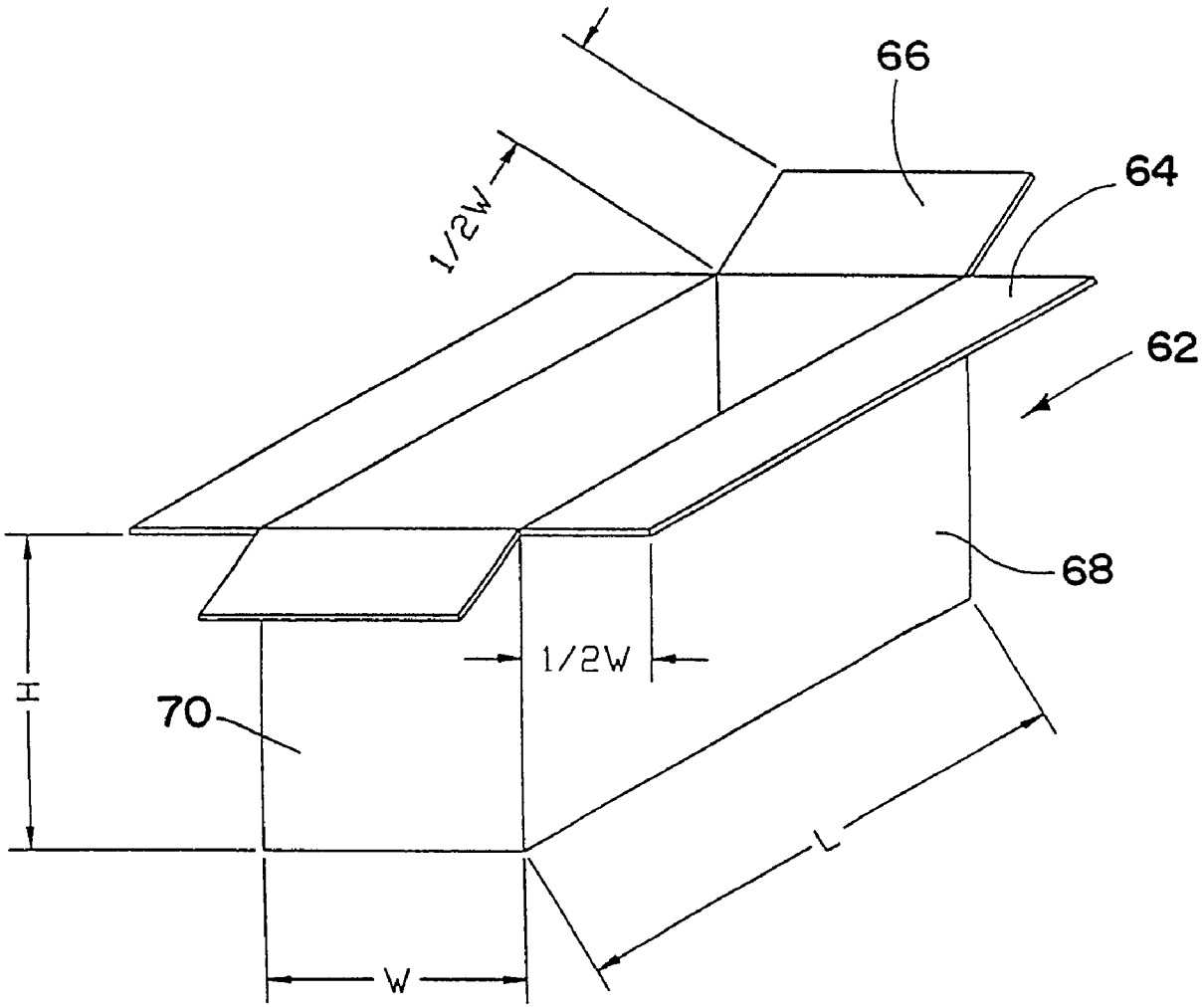
FIG. 4 is a perspective view of a standard regular slotted container (RSC).

While the illustrated system 10 could be used with different types of containers, a common container is the regular slotted container (RSC). As illustrated in FIG. 4, an RSC 62 has a specified relationship between the width of the container W and the height of the side flaps 64 and end flaps 66. That is, the flaps 64 and 66 have a height one half the width W of the container. Accordingly, the height H of the side walls 68 and end walls 70 of the container (i.e., the height of the container when closed, also the height of the container without the flaps) can be determined from a measure of the height of the container with the top flaps 64 and 66 upright in their unfolded state, in line with corresponding side walls of the container. The height of the side and end walls (the height of the article-containing portion of the container) will be a fraction of the height of the container when the top flaps 64 and 66 are upright and unfolded.

For an RSC-style container, the height sensor measures the container height assuming that the flaps are upright, and then half the measured width can be subtracted to get the estimated "true" height of the container when the flaps later are folded down to close the container. For shoebox-style containers, the measured height should be the same as the true height.

When one or more flaps of an RSC-style container are folded away from the upright position, the height sensor may cause the logic unit to incorrectly calculate the true height of a container to be as much as one half the container width less than the height actually is. Thus when the container is partially or completely closed, the height sensor will cause the logic device to incorrectly conclude that the top of the container is up to one half the container width below the actual height of the container.

While the illustrated embodiment generally measures the height of the container with the top flaps 64 and 66 upright and unfolded, those skilled in the art will appreciate that the height H can be detected or measured directly from the height of the side walls of the container, such as for a shoebox-style container or when the flaps 64 and 66 are folded outward to at least ninety degrees from vertical. As discussed below, when the flaps are folded in and down over the open side of the container to partially or completely close the opening into the container, the void volume generally cannot be determined with certainty because the areas of the container shaded by the flaps are hidden from the container scanner 14.

Figure 5:
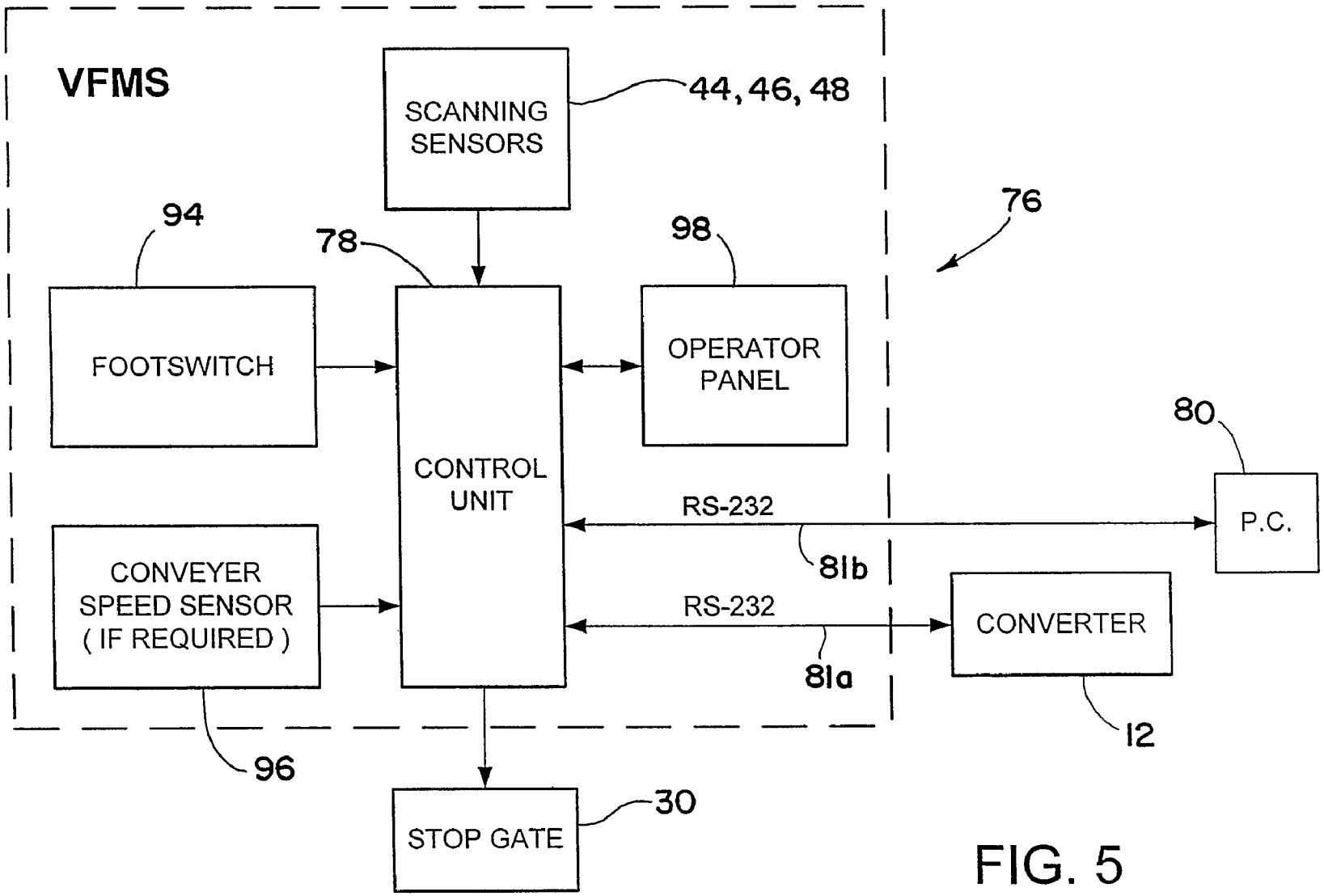
FIG. 5 is a block diagram of a logic device used to control the void-fill measuring and dispensing system of FIG. 1.

The various operative components of the system 10 are controlled by a logic device 76, which is diagrammatically shown in FIG. 5. The various functions of the logic device 76 can be performed by a single controller, such as a control unit 78 for the container scanner 14. It may be desirable to distribute the functions of the logic device 76 among several controllers, however, each of which has separate processors, such as among the control unit 78, a controller for the dunnage dispenser 12 (FIG. 1) and/or a microprocessor of a personal computer 80. As used herein, the logic device 76 encompasses the processor or processors of the system that control the operation of the system 10. The processor can be any one of a number of commercially available processors such as PLCs and general purpose processing chips with various output and input ports and associated memory devices including ROM and RAM. The logic device can be controlled by suitable software that among other things uses dimension characteristic data received from the container scanner's sensors to determine container length, width, height and top void fill volume. Alternatively, the container can be identified from input by an operator or a bar code, and the container dimensions can be determined from data stored in a memory or encoded in the bar code. The logic device 76, in cooperation with the container scanner 14, provides means for determining the dimensions of the container, whether the container scanner 14 includes one or more of the height, width, or contour sensors or a bar code sensor.

Figure 6:
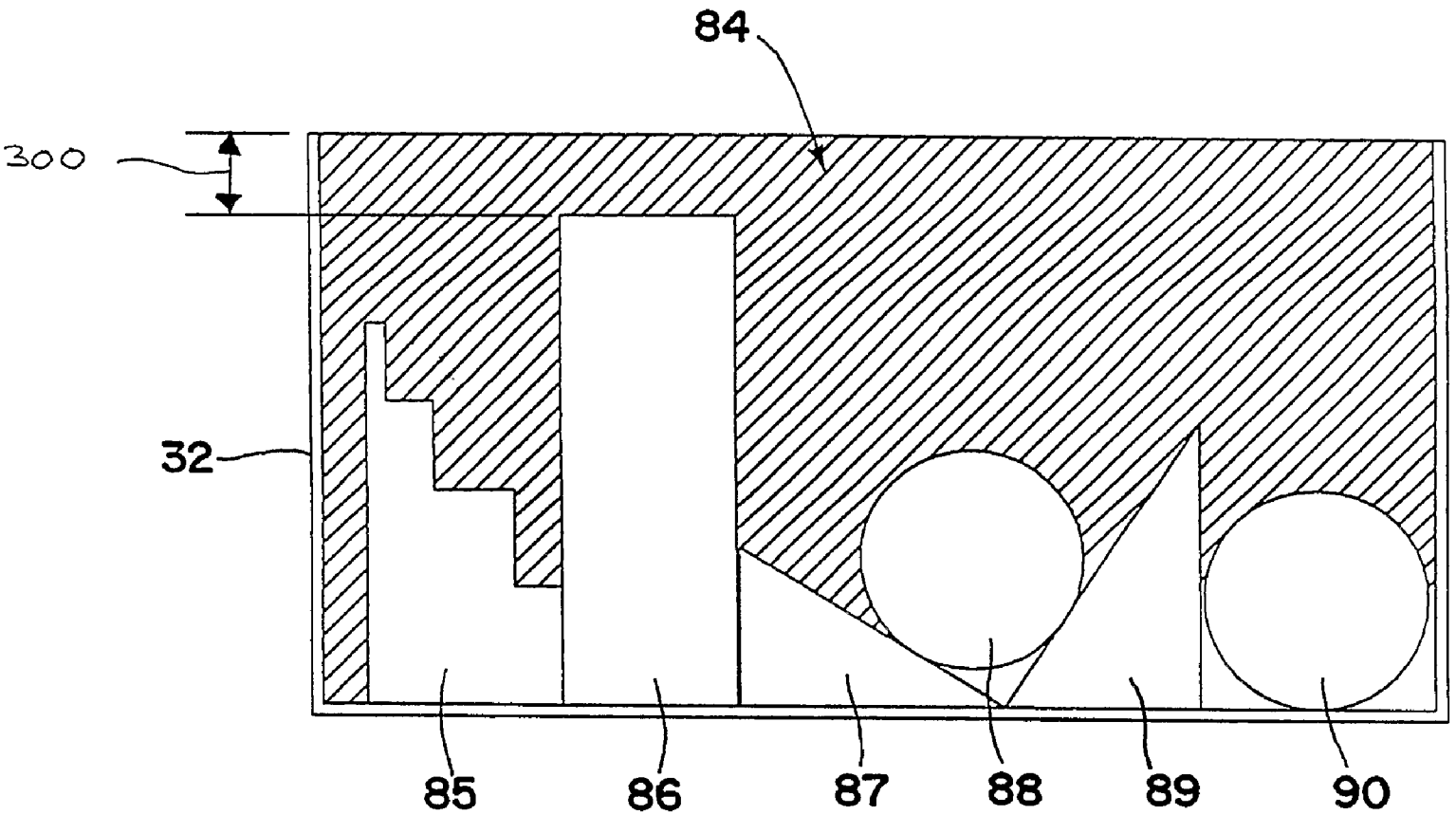
FIG. 6 is a schematic cross-sectional view of a container in which several articles have been placed and with the remaining void being denoted by cross-hatching.

Generally the logic device 76 is operable to process detected dimensional characteristic information received from the height sensor 44, width sensor 46 and contour sensor 48. The logic device 76 then determines the dimensions of the container; the height of the container and/or its contents in the scan area; the void volume, if any; and the amount of dunnage material needed to fill the void above the one or more articles that have been placed in the container (or the bottom wall of the container if not overlain by an article). In FIG. 6, the void volume is illustrated by the cross-hatching 84 while the articles in the container 32 are represented by the shapes identified by reference numbers 85 through 90. After the amount of dunnage material needed to fill the void volume is determined, and no fault condition is found, the logic device 76 commands the dunnage dispenser 12 (FIG. 1) to dispense the determined amount of dunnage material. The dunnage material can flow directly into the container automatically and/or be placed or guided into the container by an operator.

In the illustrated exemplary system, the dunnage dispenser 12 includes means for converting a stock material into a dunnage product, and particularly a dunnage converter that converts one or more plies of sheet stock material (typically kraft paper) into a relatively less dense dunnage material. Exemplary dunnage converters are disclosed in U.S. Pat. No. 5,123,889 and in International Patent Application No. PCT/US01/18678, published in English under International Publication No. WO 01/94107, both of which are hereby incorporated herein by reference in their entireties. Other types of dunnage dispensers can be used, such as other types of dunnage converters; dispensers for other types of dunnage, such as plastic peanuts; etc. Many such dispensers are today controlled by microprocessors, which can readily be interfaced with the control unit 78 and/or programmed to carry out one or more of the herein described functions of the logic device 76. In the case of a dunnage converter, the dunnage material can be produced on site and in response to a command from the logic device 76.

As illustrated in FIG. 5, the control unit 78 can interface with the dunnage dispenser 12 and with a personal computer 80 by RS-232 serial connections 81*a* and 81*b*, for example. The control unit 78 is equipped with various ports for connection with various input and output devices, including, for example, the scanner sensors 44, 46 and 48, a foot switch 94, a conveyor speed sensor 96, the stop gate 30 and an operator panel 98. As seen in FIG. 1, the foot switch 94 and the operator panel 98 generally are located in the vicinity of the dunnage dispenser 12 for use by the human operator/packer.

As the system operates, the status of the operation can be indicated by suitable indicators on the operator panel 98 or other output devices, such as a buzzer, light, display, etc. For example, the operator panel 98 can include a power-on indicator, a scan-complete indicator, a scan-fault indicator and a converter-ready indicator. The scan-fault indicator can generate a visual or audible signal, or both.

The logic device 76 can also be equipped with one or more input devices such as a mouse, a keyboard, a keypad, a touch screen, etc. For example, the operator panel 98 can be equipped with a touch screen as an input device, or the personal computer 80 can have a touch screen or other input device associated therewith. In this manner, a scan reset input is provided to enable the operator to clear a fault condition or reset the system for some other reason. The operator panel and/or personal computer can have a monitor for displaying the various indicators and/or other information, such as the measured dimension of the container, the total volume of the container, the volume of the contents of the container, and the volume of the void above the container contents.

Additionally, the operator panel and/or personal computer can be provided with a selector device enabling the selection of a void-fill density from a plurality of void-fill densities. The selector device is an input device, such as a dial, whereby a desired density can be dialed in, a mouse pointer, a touch screen with one or more input regions, a keyboard or keypad for entry of a desired void-fill density, etc.

In accordance with the selected void-fill density, the logic device 76 varies the amount of dunnage material to be dispensed per measured volume of void, thereby to provide the selected void-fill density. That is, the logic device 76 can be programmed to have a default setting where it will command X amount of dunnage to be dispensed for each unit volume of measured void. But if minimal protection is needed, for example, the operator can select a lower void-fill density. In this case, the logic device 76 will command that 10% less dunnage material is dispensed per given unit of measured top-fill void, for example. This will result in a lower density fill of the container and will consume a smaller quantity of dunnage material. On the other hand, if greater protection is needed and/or the articles packed in the container are heavier, the operator can select a higher void-fill density. In this case, the logic device 76 will command 10% more dunnage material to be dispensed per given unit of measured top-fill void, for example.

The above-described exemplary system 10 operates in the following manner. As depicted in FIG. 1, containers 32 that contain one or more articles, such as products for shipping, are conveyed by the powered section 20 of the conveyor 18 toward the void-fill scanner 14. The containers are justified by suitable means to one side of the conveyor 18, and generally against the guide rail 52 (FIGS. 2 and 3). The containers are stopped by the stop gate 30 before entering the scan region 16. The containers 32 generally travel through the scan region 16 with some separation between them to facilitate detecting the dimensional characteristics of each container and its contents. When the operator steps on the foot switch 94, the control unit 78 instructs the stop gate 30 to release the leading container for movement into and through the scan region 16. After the container is released, the stop gate returns to its capture position to prevent the next container from moving into the scan region 16 until commanded by the logic device 76.

As a container moves through the scan region 16, it is scanned by the sensors 44, 46 and 48 to detect the height, width and contour characteristics of the container and its contents. The logic device 76 processes the sensed characteristic information received from the height sensor 44, the width sensor 46 and the contour sensor 48 to determine the container dimensions. The logic device 76 then checks for a fault condition, such as one or more flaps of the container being folded inward, the contents of the container exceeding the height of the container, etc. In particular, the logic device compares the detected height of the container and/or its contents to pre-specified criteria.

When the logic device 76 determines that the detected height of the container and/or its contents exceed the pre-specified criteria, a signal is generated that indicates that the height has exceeded the pre-specified criteria. That signal can be used to stop the conveyor, to alert an operator that the container requires the operator's attention, or to divert the container for special attention. In the latter situation, the container can be diverted from the path leading from the container scanner to the dunnage dispenser and guided onto another conveyor to another station for containers that require special handling. The fault condition can be corrected and the container returned to the conveyor upstream of the container scanner, or dunnage can be dispensed and the container closed for shipment at the special handling station.

Once the container dimensions are determined, and no fault condition has been found, the logic device 76 determines the volume of the container when empty from the determined dimensions and the void volume from the contour characteristics in the scan area, and calculates or otherwise determines the quantity of dunnage material needed to fill the determined void volume. After scanning, the container enters the non-powered section 22 of the conveyor where an operator can reach and then position the container in front of the outlet of the dunnage dispenser 12. The operator then steps on the foot switch 94, which signals the dunnage dispenser 12 to dispense the determined amount of dunnage material needed to top fill the container, including providing dunnage from a converter.

The operator typically only initiates the dispensing of the dunnage. The operator does not control the quantity of dunnage dispensed. After the container has been filled with dunnage, it can be passed on for further processing, such as through a container closer 102 and then onto a further powered conveyor 104.

Generally the foot switch 94 is enabled only when the converter-ready light is on and the scan-fault indicator light is off. The scan-fault indicator when lit indicates a fault that requires an operator's attention. Possible fault conditions include a no-container-detected condition, a measured container size below a preset minimum and/or above a preset maximum, a closed container (flaps folded partially or completely inward over the open side of the container) and/or a measured top void volume that is negative (no article in the container) or exceeds the container volume (container overfull). When a fault is detected, the container can be diverted from the conveyor for special processing by an operator, or the conveyor can be stopped and an operator alerted to the fact that a fault has been detected. The operator resolves the fault condition before restarting the conveyor. If the container is full, no dunnage is needed and the operator can depress the foot switch 94 to release the container and allow another container to pass through the scan region 16 without dispensing any dunnage to the full container.

In this system, the sensors and the logic device work together to detect container faults. One of the faults addressed by this system is one or more flaps partially or completely folded over the open side of the container. The open side is the side of the container with an opening through which articles can be placed in the container. The height of the container is the dimension between the open side of the container and an opposing bottom wall of the container. The height is not limited to the vertical dimension. If the container is supported on a side wall, for example, the height can be horizontal. In an inwardly-folded flap situation, one or more flaps shade the opening from the contour sensor, which prevents the contour sensor from detecting the contour of the surface of the container and/or its contents behind the flap.

One approach to detecting faults includes defining criteria in which the container is deemed to be full, overfull, or partially or completely closed. The logic device can track the number of locations inside the perimeter of the container—defined by the upright side walls—where the contour sensor measures a height that exceeds the determined height of the container. If the percentage of these values is greater than a threshold value, set somewhere between 0% and 100%, such as at 80%, the container is considered to be closed. A closed container is a fault condition because the void volume cannot be determined with certainty. The container generally requires the attention of an operator to determine whether the container if full or requires dunnage to fill the void volume.

Another way to further refine closed container detection includes defining an overfill head space 300 (FIG. 6). Overfill head space is the distance below the calculated container height where the container is considered "full" for closed container detection purposes. What is "full" can vary dependent on the type of articles being shipped, the mode of transport, the thickness of a dunnage product or other criteria. This parameter can be particularly useful in determining whether a shoe-box style container is full, since this type of container has a separate lid rather than foldable flaps. For example, the logic device can be programmed to determine a quantity of dunnage to dispense if the determined void volume is greater than pre-specified criteria, including a predetermined minimum void volume or a predetermined percentage of the volume of the container when empty. If the pre-specified criteria are exceeded, the logic device can generate a signal that indicates that the void volume exceeds the pre-specified criteria before dispensing dunnage.

Figure 7:
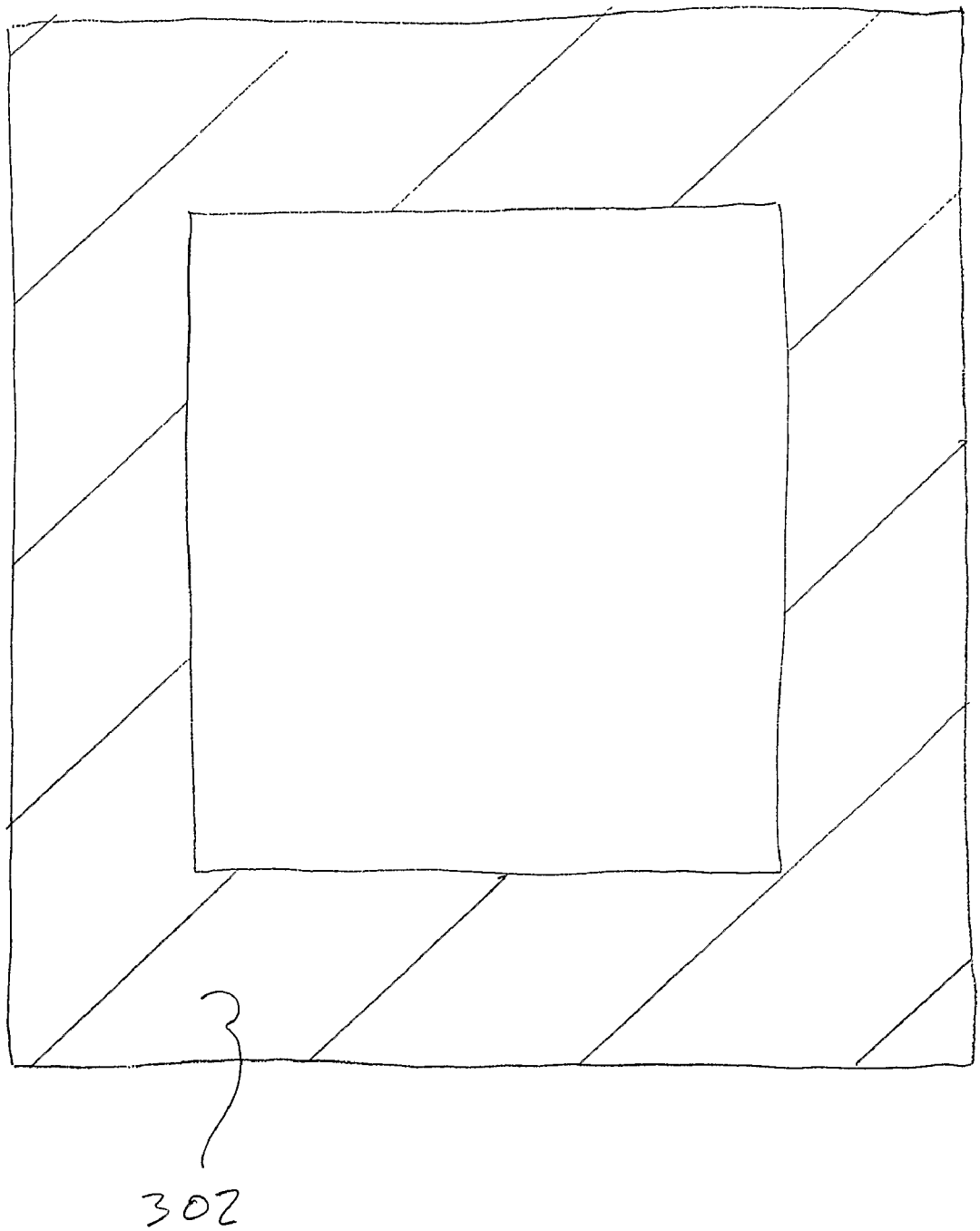
FIG. 7 is a plan view of a container within which one or more articles can be placed for shipment.

Still another parameter that can be used to refine detecting a closed container is an overfill frame width. Looking down on the top of a container in FIG. 7, there is a shaded zone 302 around the inside perimeter of the container where the information from the contour sensor is ignored by the logic device. This reduces the amount of area to be scanned for determining whether the container is closed, and avoids or minimizes errors from the flaps extending slightly inward, for example, which might interfere with the sensors in the area adjacent the flaps and/or the side walls of the container, e.g. The logic device can estimate the void volume from the determined container dimensions and the void volume from the detected dimensional contour characteristics. In ignoring this area inside the container, slightly inwardly-folded flaps can be ignored without interrupting the packaging operation or requiring an operator's attention, while still providing a reasonable quantity of dunnage.

Although the foregoing is an exemplary way to operate the system, other ways to operate the system are contemplated within the scope of the present invention. For example, after the dunnage dispenser is commanded to provide the determined amount of dunnage material needed to fill the void left in the container, the dunnage converter or other dunnage dispenser can dispense the dunnage material in different ways. The dunnage material can be dispensed by the operator-initiated method described above, or, alternatively, the operator can interrupt the dunnage dispensing process, if needed to catch up with the dunnage converter, for example. The operator can then depress the foot switch again to continue dispensing dunnage material until the determined amount of dunnage is produced. Again, the operator does not control the total quantity of dunnage dispensed, only the timing for when the dunnage is dispensed.

To summarize, the method of operation leads to an exemplary packaging system that can be described as including (a.) means for determining the dimensions of a container (the container scanner 14 and one or more related sensors 44, 46, 48 and the logic device 76, for example); (b.) means for detecting a height of the container and its contents in one or more locations within a scan area of an open side of the container (the contour sensor 48, for example); (c.) means for comparing the detected height of the container and/or its contents to pre-specified criteria (the logic device 76, for example); and (d.) means for generating a signal that indicates that the scan area includes a height that exceeds the pre-specified criteria when the detected height exceeds the pre-specified criteria (the logic device 76 and an output device, for example).

Another exemplary packaging system includes (a.) means for determining the volume of a container when the container is empty (the container scanner 14 and one or more related sensors 44, 46, and 48 and the logic device 76, for example); (b.) means for determining a void volume inside the container (the contour sensor 48 and the logic device 76, for example); (c.) means for comparing the determined void volume to pre-specified criteria (the logic device 76, for example); and (d.) means for generating a signal that indicates that the determined void volume exceeds the pre-specified criteria if the determined void volume exceeds the pre-specified criteria (the logic device 76 and an output device, for example).

Although the invention has been shown and described with respect to certain preferred embodiments, it is obvious that equivalent alterations and modifications will occur to others skilled in the art upon the reading and understanding of this specification and the annexed drawings. In particular regard to the various functions performed by the above described components, the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention can have been disclosed with respect to only one of the several embodiments, such feature can be combined with one or more other features of the other embodiments as can be desired and advantageous for any given or particular application.

What is claimed is:

1. A packaging method comprising the following steps:

a. determining the dimensions of a container;

b. detecting a height of the container and its contents in one or more locations within a scan area of an open side of the container;

c. comparing the detected height of the container and/or its contents to pre-specified criteria; and d. when the detected height exceeds the pre-specified criteria, generating a signal that indicates that the scan area includes a height that exceeds the pre-specified criteria.

2. A method as set forth in claim 1, wherein the detecting step includes using a contour sensor to scan the scan area to determine a contour of the container and its interior space in the scan area.

3. A method as set forth in claim 1, wherein the determining step includes using one or more sensors to detect at least one of a height characteristic, a width characteristic, a length characteristic and a contour characteristic of a container and its contents.

4. A method as set forth in claim 1, comprising the step of determining a void volume in the container from the determined dimensions of the container and the detected height of the container and its contents in the scan area.

5. A method as set forth in claim 4, comprising the step of determining a quantity of dunnage needed to fill the determined void volume.

6. A method as set forth in claim 5, comprising the step of providing the determined quantity of dunnage.

7. A method as set forth in claim 6, wherein the providing step includes converting a sheet stock material into a dunnage product.

8. A method as set forth in claim 1, comprising the step of setting the pre-specified criteria as a height at a predetermined number of locations that exceeds the determined height dimension of a container.

9. A method as set forth in claim 1, comprising the step of setting the pre-specified criteria as the detected height exceeding a predetermined percentage of the determined height of the container.

10. A method as set forth in claim 1, wherein the generating step includes generating an audible or visual signal.

11. A method as set forth in claim 1, wherein the generating step includes generating a signal to stop a conveyor transporting the container.

12. A method as set forth in claim 1, wherein the generating step includes generating a signal to divert a container from a path to a dunnage dispenser.

13. A method as set forth in claim 1, comprising the step of calculating a void volume inside the container from the determined dimensions of the container and the detected height of the container and its contents in the scan area when the detected height does not exceed the pre-specified criteria.

14. A method as set forth in claim 1, comprising the step of determining a quantity of dunnage to dispense if the void volume is greater than a predetermined minimum void volume.

15. A method as set forth in claim 1, wherein the detecting step includes detecting a height in a scan area, where the scan area is less than a full cross-section of the container, the full cross-section of the container being defined by the perimeter of the open side of the container at top edges of the side walls of the container.

16. A method as set forth in claim 1, comprising the step of defining a perimeter of the container as an outside perimeter and defining an inside perimeter that is offset a predetermined distance inside the outside perimeter as the perimeter of the scan area.

17. A method as set forth in claim 1, comprising the step of setting the pre-specified criteria as the detected height exceeding a predetermined height that is less than the determined height of the container.

* * * * *